US006405488B1

(12) United States Patent
Brown

(10) Patent No.: US 6,405,488 B1
(45) Date of Patent: Jun. 18, 2002

(54) WINDOW INSULATOR

(76) Inventor: Toni L. Brown, 2013 Pine Pep Rd., Reisterstown, MD (US) 21136

( * ) Notice: Subject to any disclaimer, the term of this patent is extended or adjusted under 35 U.S.C. 154(b) by 0 days.

(21) Appl. No.: 09/847,979

(22) Filed: May 3, 2001

(51) Int. Cl.[7] ..... E05D 15/16
(52) U.S. Cl. ..... 49/406
(58) Field of Search ..... 49/406, 458, 475.1, 49/498.1

(56) References Cited

U.S. PATENT DOCUMENTS

| | | | | |
|---|---|---|---|---|
| 1,885,922 A | | 11/1932 | Kunz et al. | |
| 2,134,477 A | | 10/1938 | Hendriksen | |
| 3,383,801 A | | 5/1968 | Dallaire | |
| 4,604,831 A | | 8/1986 | Tunnicliffe et al. | |
| 4,726,147 A | * | 2/1988 | Beske et al. | 49/406 |
| 4,802,308 A | | 2/1989 | Hitzig | |
| 4,827,685 A | | 5/1989 | Schmidt | |
| 5,111,616 A | | 5/1992 | Calabrese | |
| D371,600 S | | 7/1996 | Henry | |

FOREIGN PATENT DOCUMENTS

| | | | | |
|---|---|---|---|---|
| EP | 36189 | * | 9/1981 | 49/406 |

* cited by examiner

*Primary Examiner*—Jerry Redman
(74) *Attorney, Agent, or Firm*—John A. Galbreath

(57) ABSTRACT

A uniquely constructed window insulator (10) that effectively seals the gap (17) between the upper sash (15) and the lower sash (16) of a double-hung window against drafts and other thermal loss. The device has an elongated, tubular shape and a sash lock opening (11), located on its bottom surface and sized to accommodate the sash lock (18) of a double-hung window. A thermally insulating layer (13), constructed of open or closed-cell foam or any suitable insulating material, is surrounded by a decorative cover (12), and itself surrounds an inner core of particulate weighting material (14). When installed, the sash lock (18) on the window projects into the sash lock opening (11) of the device, allowing the device to lie completely flat against the top of the lower sash (16) and the front of the upper sash (15), thereby completely sealing the opening between the two sashes.

20 Claims, 4 Drawing Sheets

WINDOW INSULATOR

CROSS-REFERENCES TO RELATED APPLICATIONS

Not applicable.

BACKGROUND

1. Field of the Invention

This invention is in the area of window insulating devices, specifically a uniquely constructed window insulator which effectively seals the gap between the upper and lower sashes of a double-hung window against drafts and other thermal loss.

2. Description of the Related Art

"Elongated pillow" draft preventers are known in the art. However, they have been employed to seal the bottom of a door against drafts, and not the middle interface between the top and bottom sashes of a double-hung window. An example of such a device is shown in U.S. Pat. No. Des. 371,600 to Henry, wherein the draft preventer is used to seal the bottom of a door. However, the device of Henry cannot be suitably used to seal the sash interface of a window, because the sash lock interferes with the proper sealing of the device against the top of the bottom sash and the front of the top sash. Relatedly, Henry's device will not remain in optimum sealing position, but rather tends to "sag back" from the upper sash. Finally, because the sash lock interferes with the device, a flat, smooth and non-conspicuous appearance of the device on the window cannot be obtained.

To seal the interface between the two sashes of a double-hung window, generally a non-removable gasket or weatherstrip has been used. Examples of various types of these are shown in U.S. Pat. Nos. 5,111,616 to Calabrese; 4,802,308 to Hitzig; 4,604,831 to Tunnicliffe et al.; and 2,134,477 to Hendriksen. Interlocking seals or closure strips serving the same function are shown in U.S. Pat. Nos. 3,383,801 to Dallaire; 1,885,922 to Kunz et al.; and 4,827,685 to Schmidt. None of the above gasket/weatherstrip prior art is removable, as the invention is—rather, the gasket or seal is permanently attached to the window itself.

Accordingly, several objects and advantages of. the invention are:

It very effectively seals the gap between the upper and lower sashes of a double-hung window. This invention not only blocks drafts—thermal loss through air convection—but also, because of the insulating properties of its foam inner layer, prevents radiant and conductive thermal loss.

The unique sash lock opening in the bottom surface of the window insulator permits the sash lock to project into the insulator, thereby allowing the device to lie flat across the width of the window for an improved appearance and maximum sealing performance. In addition, the engagement of the sash lock into the sash lock opening acts to secure the insulator in place over the gap between the upper and lower sashes, and prevents it from "sagging back" from the upper sash.

Unlike some prior art devices, the invention can be quickly and easily installed in a window without tools, and can be easily removed when needed—to open the window or when a more formal window appearance is desired.

The decorative covering, although not essential to the invention, can be color-matched to the window frame, such that the insulator will be nearly imperceptible while in use.

Further objects and advantages of the invention will become apparent from a consideration of the drawings and ensuing description.

SUMMARY

The invention is a uniquely constructed window insulator which effectively seals the gap between the upper and lower sashes of a double-hung window against drafts and other thermal loss.

DETAILED DESCRIPTION OF THE INVENTION

Figure 1:
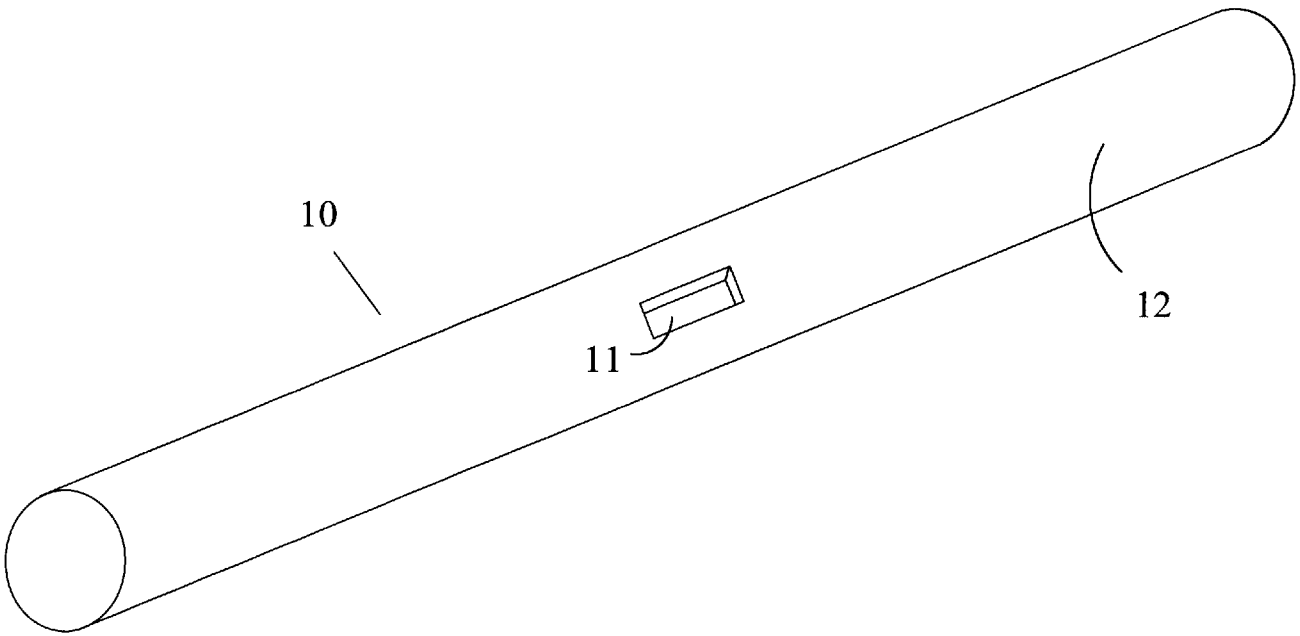
FIG. 1 is a perspective view of the insulator, particularly its bottom surface and the sash lock opening located thereon.

The following provides a list of the reference characters used in the drawings:

10. Window insulator
11. Sash lock opening
12. Decorative cover
13. Thermally insulating layer
14. Particulate weighting material is. Upper sash
16. Lower sash
17. Gap
18. Sash lock
19*a*&*b*. Length adjusters (alternative embodiment)

FIG. 1 provides an overall perspective view of the invention, particularly illustrating its bottom surface. Window insulator 10 has an elongated, tubular shape and an outer decorative cover 12. A sash lock opening 11, sized to accommodate the sash lock of a double-hung window, is located on the bottom surface of window insulator 10 approximately halfway between its two ends.

Figure 2:
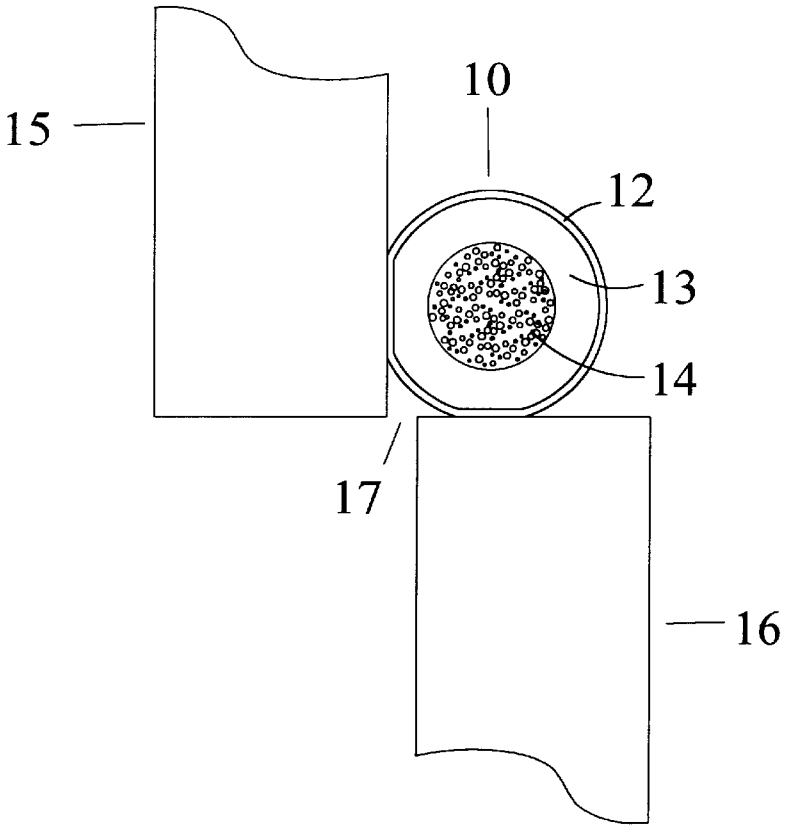
FIG. 2 is a cutaway side view showing the device installed over the gap between the upper and lower sashes, and further, illustrating its internal construction.

FIG. 2 illustrates, in cutaway side view, the invention in place over a gap 17 between an upper sash 15 and a lower sash 16 of a double-hung window. A thermally insulating layer 13, constructed of open or closed-cell foam or any other suitable insulating material, is surrounded by decorative cover 12, and itself surrounds an inner core of particulate weighting material 14. Although not shown. in FIG. 3, thermally insulating layer 13 extends along the length of window insulator 10, except for that portion of thermally insulating layer 13 which is cut out to form sash lock opening 11. Similarly, particulate weighting material 14 extends along the length of window insulator 10, except for of course that portion of window insulator 10 in the area of sash lock opening 11. It can also be seen that the flexible nature of window insulator 10 permits it to conform, and seal well against the top of the lower sash and the front of the upper sash.

Figure 3:
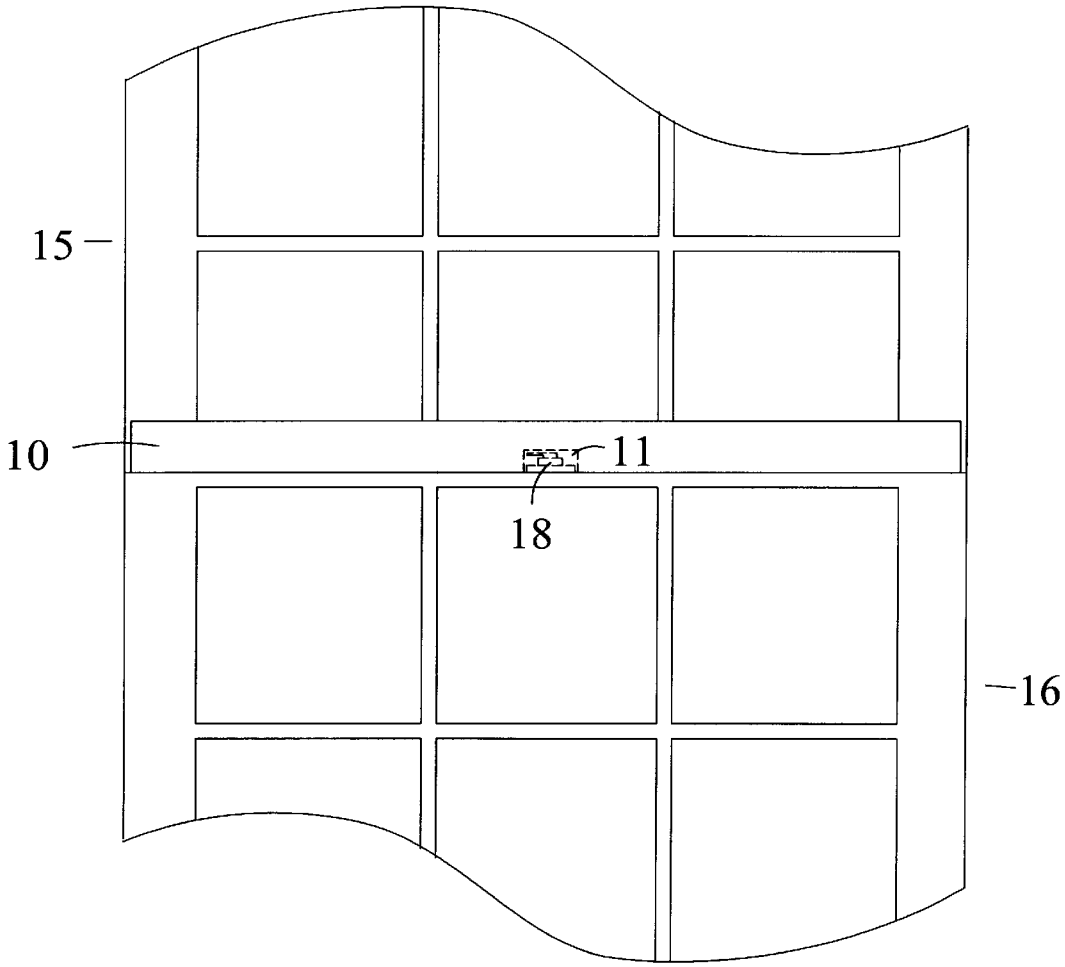
FIG. 3 is a front view of the device installed in a double-hung window, with the sash lock projecting inside the device.

FIG. 3 is a front view of the device in place in a double-hung window. A sash lock 18 (shown with hidden lines) protrudes from the top of lower sash 16 and the front of upper sash 15, and projects into sash lock opening 11 of window insulator 10. This allows window insulator 10 to lie completely flat against the top of lower sash 16 and the front of upper sash 15, thereby completely sealing the opening between the two sashes against drafts and other thermal loss.

Figure 4:
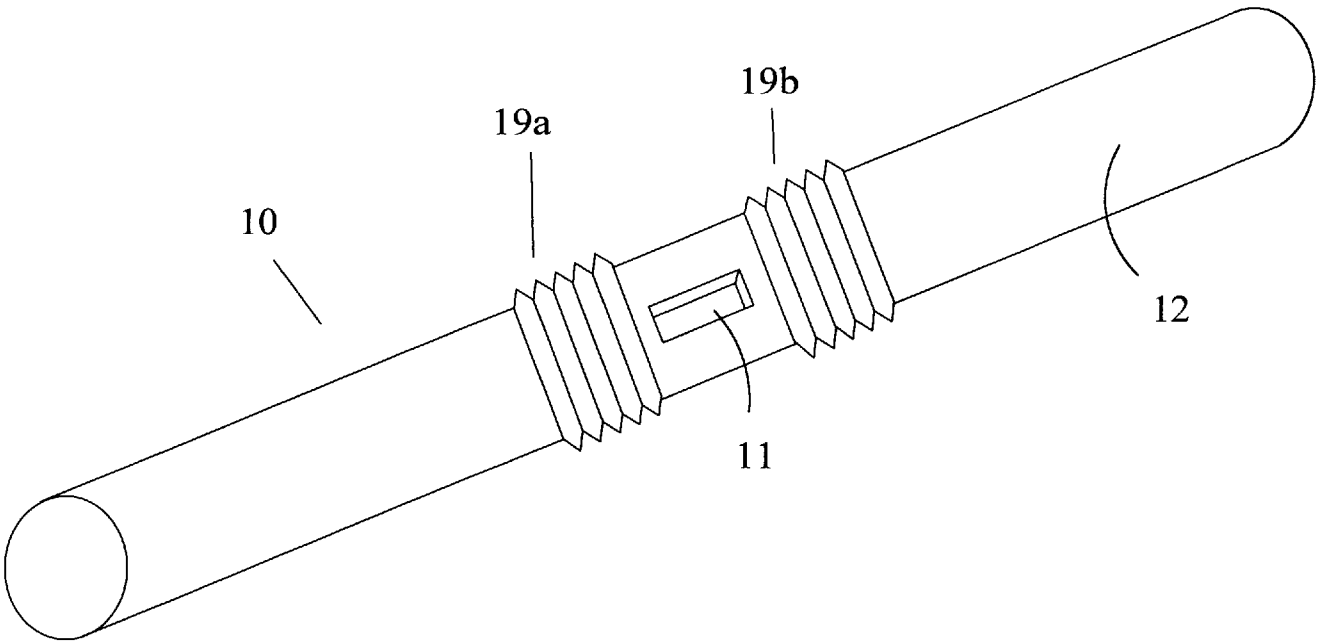
FIG. 4 is a perspective view of an alternative embodiment, wherein telescoping adjustment means are located on either side of the sash lock opening, so that the length of the device can be adjusted to fit windows having various widths.

FIG. 4 illustrates an alternative embodiment, with telescoping length adjusters 19*a*&*b* located on either side of sash lock opening 11. Length adjusters 19*a*&*b* extend around the outer circumference of window insulator 10 and form a part of its structure, such that the length of window insulator 10 can be adjusted by stretching or compressing length adjusters 19*a*&*b*. Thus, window insulator 10 can be adjusted to fit windows having various widths.

Conclusions, Ramifications, and Scope:

Thus the reader will see that this invention provides a very convenient and effective way of sealing the gap between the sashes of a double-hung window. while the above descriptions contain many specificities, these shall not be construed as limitations on the scope of the invention, but rather as exemplifications of embodiments thereof. Many other variations are possible. Examples of just a few of the possible variations follow:

The sash lock opening can be of different shape or size (to accommodate sash locks of different shape, size, or design), or there may be multiple sash openings to accommodate windows which, for example, have two sash locks.

The sash lock opening can be in a different position on the surface of the insulator. As just one example, it may be positioned along the length of the window insulator at a position different than the "centered" position shown in FIG. 1.

The decorative cover can be eliminated. The particulate weighting material can be sand, beads, or another suitable material; alternatively, a different, non-particulate type of weighting material can be incorporated. The particulate weighting material can even be eliminated. However, the particulate weighting material shown is advantageous in that it readily conforms to the shapes of the window sashes and also gravitationally anchors the window insulator against the sash gap.

The width adjusting means can take many different forms, and not just the stretchable/compressible length adjusters illustrated in FIG. 4.

Accordingly, the scope of the invention should be determined not by the embodiments illustrated, but by the appended claims and their legal equivalents.

What is claimed is:

1. A window insulating device, for sealing an interface between a top and a bottom sash of a window, comprising:

(a) an elongated member which is disposed on said window along the length of said interface, and (b) a sash lock opening, located on a bottom surface of said elongated member and defining an interior cavity of said elongated member, for accommodating a window sash lock, whereby said window is sealed against thermal loss through said interface.

2. The device of claim 1, wherein said elongated member has a tubular shape.

3. The device of claim 1, wherein said sash lock opening has a rectangular shape.

4. The device of claim 1, wherein said window insulating device also includes a cover.

5. The device of claim 1, wherein said window insulating device also includes a thermally insulating layer.

6. The device of claim 5, wherein said thermally insulating layer is comprised of open or closed cell foam.

7. The device of claim 1, wherein said window insulating device also includes an inner core of weighting material.

8. The device of claim 7, wherein said weighting material is comprised of particles.

9. The device of claim 8, wherein said weighting material is sand.

10. The device of claim 1, wherein said window insulating device also includes means for adjusting the length of said window insulating device.

11. A window insulator, comprising:

(a) thermally insulating means which is placed across the width of a window along the interface between a top and a bottom sash of said window, and (b) an opening, located on a bottom surface of said window insulator and defining an interior cavity of said window insulator, for accommodating a window sash lock, whereby said window is sealed against thermal loss through said interface.

12. The device of claim 11, wherein said window insulator has a tubular shape.

13. The device of claim 11, wherein said opening has a rectangular shape.

14. The device of claim 13, wherein said window insulator has a first end and a second ends and said opening is substantially centered between said first end and said second end.

15. The device of claim 11, wherein said window insulator also includes a cover.

16. The device of claim 11, wherein said thermally insulating means are comprised of open or closed cell foam.

17. The device of claim 11, wherein said window insulator also includes an inner core of weighting material.

18. The device of claim 17, wherein said weighting material is comprised of particles.

19. The device of claim 18, wherein said weighting material is sand.

20. The device of claim 1, wherein said window insulator also includes means for adjusting the length of said window insulator.

* * * * *